US005405254A

United States Patent [19]

Hennessy et al.

[11] Patent Number: 5,405,254

[45] Date of Patent: Apr. 11, 1995

[54] ROTARY FLUID DISPLACEMENT APPARATUS

[75] Inventors: David R. Hennessy, Minneapolis; James P. LeClaire, St. Paul, both of Minn.

[73] Assignee: Horton Manufacturing Co., Inc., Minneapolis, Minn.

[21] Appl. No.: 288,476

[22] Filed: Aug. 10, 1994

Related U.S. Application Data

[63] Continuation of Ser. No. 833,883, Feb. 11, 1992, abandoned.

[30] Foreign Application Priority Data

Feb. 8, 1993 [ZA] South Africa ..... 93/0850
Feb. 10, 1993 [MX] Mexico ..... 930721

[51] Int. Cl.[6] ..... F01C 1/10
[52] U.S. Cl. ..... 418/61.3; 418/166
[58] Field of Search ..... 418/61.3, 164, 166

[56] References Cited

U.S. PATENT DOCUMENTS

| | | | |
|---|---|---|---|
| 2,240,874 | 5/1941 | Thomas et al. . | |
| 3,215,043 | 11/1965 | Huber | 418/61.3 |
| 3,303,783 | 2/1967 | Neubauer | 418/166 |
| 3,377,873 | 4/1968 | Patterson, Jr. . | |
| 3,431,863 | 3/1969 | Waldorff . | |
| 3,453,966 | 7/1969 | Eddy . | |
| 3,490,383 | 1/1970 | Parrett | 418/61.3 |
| 3,532,447 | 10/1970 | Charlson . | |
| 3,547,565 | 12/1970 | Eddy . | |
| 3,561,893 | 2/1971 | Baatrup . | |
| 3,627,454 | 12/1971 | Goff et al. . | |
| 3,910,733 | 10/1975 | Grove . | |
| 3,944,378 | 3/1976 | McDermont | 418/61.3 |
| 3,979,167 | 9/1976 | Grove . | |
| 4,380,420 | 4/1983 | Wüsthof et al. . | |
| 4,411,606 | 10/1983 | Miller | 418/61.3 |
| 4,432,710 | 2/1984 | Hansen et al. | 418/61.3 |
| 4,639,202 | 1/1987 | Mahanay et al. . | |

FOREIGN PATENT DOCUMENTS

| | | | |
|---|---|---|---|
| WO9316270 | 8/1993 | WIPO | 418/61.3 |

OTHER PUBLICATIONS

Horton Tachyon® Air Motors brochure, Copyright 1989, by Horton Manufacturing Co., Inc., Minneapolis, Minn, Form #L-21391-0-0789.

*Primary Examiner*—Richard A. Bertsch
*Assistant Examiner*—Charles G. Freay
*Attorney, Agent, or Firm*—Peterson, Wicks, Nemer & Kamrath

[57] ABSTRACT

A rotary fluid displacement apparatus (100) with an orbiting toothed ring member (30) is shown with an improved casing (60) and rolling support between the faces of the valve discs (46, 47) and the first and second fluid transfer elements (21, 35). Particularly, needle bearings (106, 112) are sandwiched between thrust washers (108,114) and then between the valve discs (46, 47) and the fluid transfer elements (21, 35), with one of the needle bearings (106) being piloted in an annular groove (110) formed in the annular plate (23) of the first fluid transfer element (21) and the other of the needle bearings (112) being piloted on the hub (35') of the second fluid transfer element (35). The casing (60) includes two pieces, i.e. a generally cylindrical portion (62) and an end cap (64). The portion (62) includes four cavities (70, 72, 74, 76), with the hub (35') of the second fluid transfer element (35) being in a sliding rotatable, and sealing relation with the axially inner cavity (76) and the end cap (64) being in sliding and sealing relation with the axially outer cavity (70). The end cap (64) includes a cavity (90) for slideably, rotatably, and sealing receipt of the hub (24) of the first fluid transfer element (21). Fluid communication is allowed axially through the end cap (64) by an axially extending fluid conduit (94) intersecting with the cavity (90) of the end cap (64) and by an axially extending fluid port (98) which intersects with first and second axially extending fluid bores (82, 96) formed in the generally cylindrical portion (62) and the end cap (64) which in turn intersects with a radially extending fluid conduit (80) terminating in the axially inner cavity (76).

20 Claims, 2 Drawing Sheets

ROTARY FLUID DISPLACEMENT APPARATUS

CROSS REFERENCE

This application is a continuation of international application number PCT/U.S. Pat. No. 93/01204 filed Feb. 2, 1993, which is a continuation of U.S. application Pat. No. 07/833,883, filed on Feb. 11, 1992, now abandoned.

BACKGROUND

The present invention relates generally to rotary fluid displacement apparatus such as pumps, motors, or combination motor-pumps or metering devices, and particularly to improvements to such rotary fluid displacement apparatus which increase product life and efficiency.

The most important interface between parts in a rotor stack assembly of a rotary fluid displacement apparatus with an orbiting toothed ring member occurs between the valve discs including the fluid passages and the elements including the fluid transfer passageways. This interface is crucial because it can affect timing and efficiency and is where the largest wear problems occur. Specifically, the valve discs formed of torlon tend to wear into the elements typically formed of zinc and including the fluid transfer passageways. In addition to affecting the valving operation, such wear causes the rotor stack assembly to loosen which may accelerate wear in other parts. Also, the elements including the fluid transfer passageways tend to wear away in very fine grains which spread throughout the apparatus. The lubrication for the many moving parts inside the casing of prior rotary fluid displacement apparatus mixed with the zinc particles to form a slurry which was very abrasive to other moving parts of the apparatus.

Also, the casing can play a significant role in the life and performance of the apparatus. Specifically, if a perfect seal is not achieved between casing parts, oil and air are allowed to leak, the effects of which are recognizable in both efficiency and aesthetics. Prior casings of rotary fluid displacement apparatus were formed from multiple parts which often promoted air leaks because of the mere number of potential leak paths, the difficulty of sealing, and the type of seals required. Prior casings were difficult and expensive to manufacture and assemble with high repeatability, were prone to wear, and tended to accentuate the noise and vibration problems inherent in an eccentric drive.

Thus, a need exists for an improved rotary fluid displacement apparatus with an orbiting toothed ring member which overcomes the problems and shortcomings of prior apparatus.

SUMMARY

The present invention solves this need and other problems in the field of rotary fluid displacement apparatus by providing, in the preferred form, rolling support between the faces of the valve disc and the fluid transfer element, with fluid passages in the valve disc being movable into and out of registration with fluid passageways in the fluid transfer element.

In another aspect of the present invention, an improved casing is provided including a generally cylindrical portion and an end cap. The generally cylindrical portion integrally includes an axially inner cylindrical cavity for the sliding, rotating, and sealing receipt of the first fluid transfer element of the rotor stack assembly, an internal gear for gearing engagement with the externally toothed gear of the rotor stack assembly, and an axially outer cylindrical cavity for the sliding and sealing receipt of the outer cylindrical surface of the end cap. The end cap also has an inner cylindrical surface for the sliding, rotating, and sealing receipt of the second fluid transfer element of the rotor stack assembly.

It is thus an object of the present invention to provide a novel, improved rotary fluid displacement apparatus.

It is further an object of the present invention to provide such a novel, improved rotary fluid displacement apparatus including rolling support between the faces of the valve disc and the fluid transfer element.

It is further an object of the present invention to provide such a novel, improved rotary fluid displacement apparatus including an improved casing.

It is further an object of the present invention to provide such a novel, improved rotary fluid displacement apparatus having increased operation efficiency.

It is further an object of the present invention to provide such a novel, improved rotary fluid displacement apparatus having increased product life.

It is further an object of the present invention to provide such a novel, improved rotary fluid displacement apparatus which can be easily, economically, and consistently manufactured and assembled.

It is further an object of the present invention to provide such a novel, improved rotary fluid displacement apparatus which lends itself to field repair.

It is further an object of the present invention to provide such a novel, improved rotary fluid displacement apparatus which reduces the number of components and potential leak paths.

It is further an object of the present invention to provide such a novel, improved rotary fluid displacement apparatus reducing noise and vibration problems.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
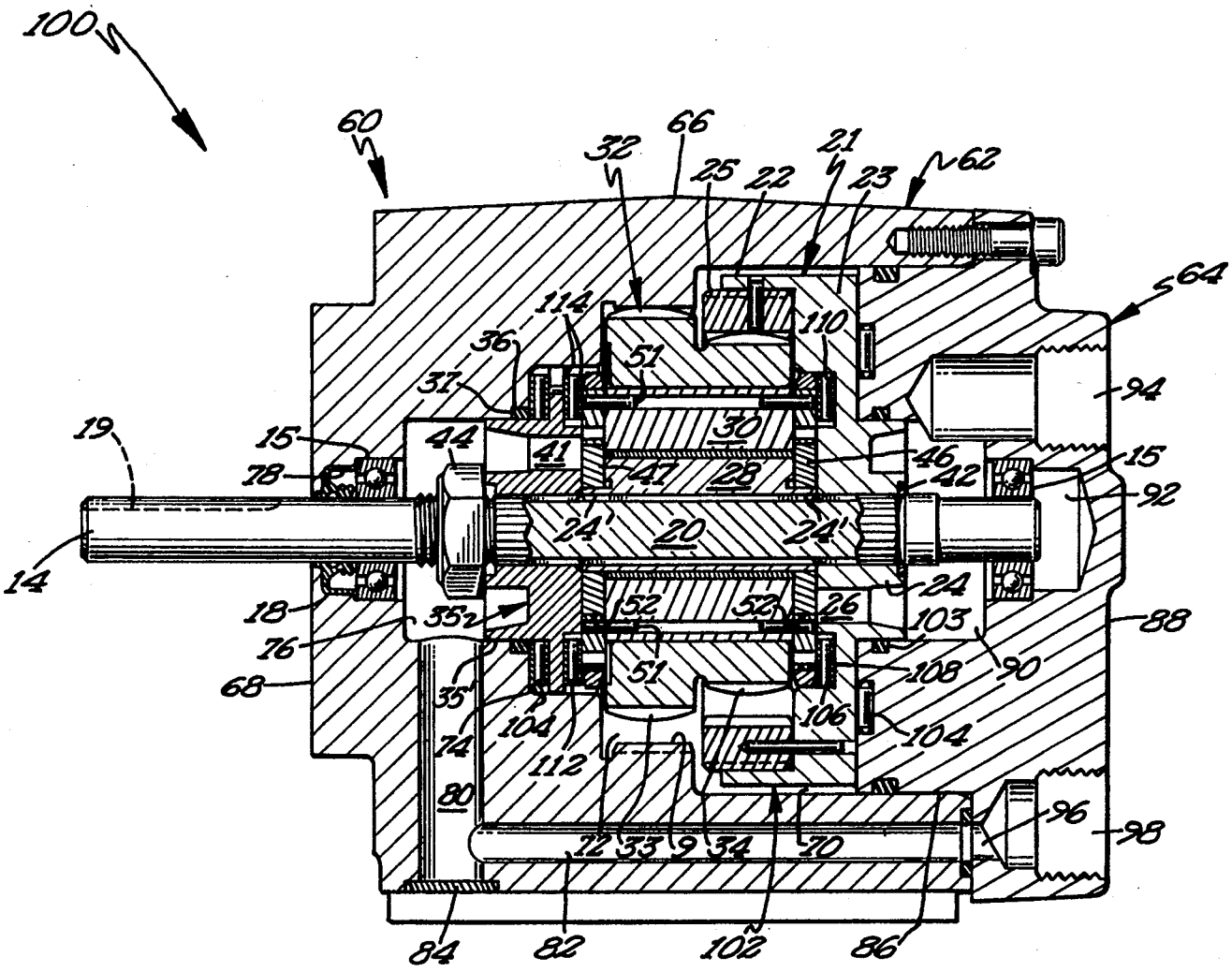
FIG. 1 shows a cross-sectional view of a rotary fluid displacement apparatus according to the preferred teachings of the present invention.
Figure 2:
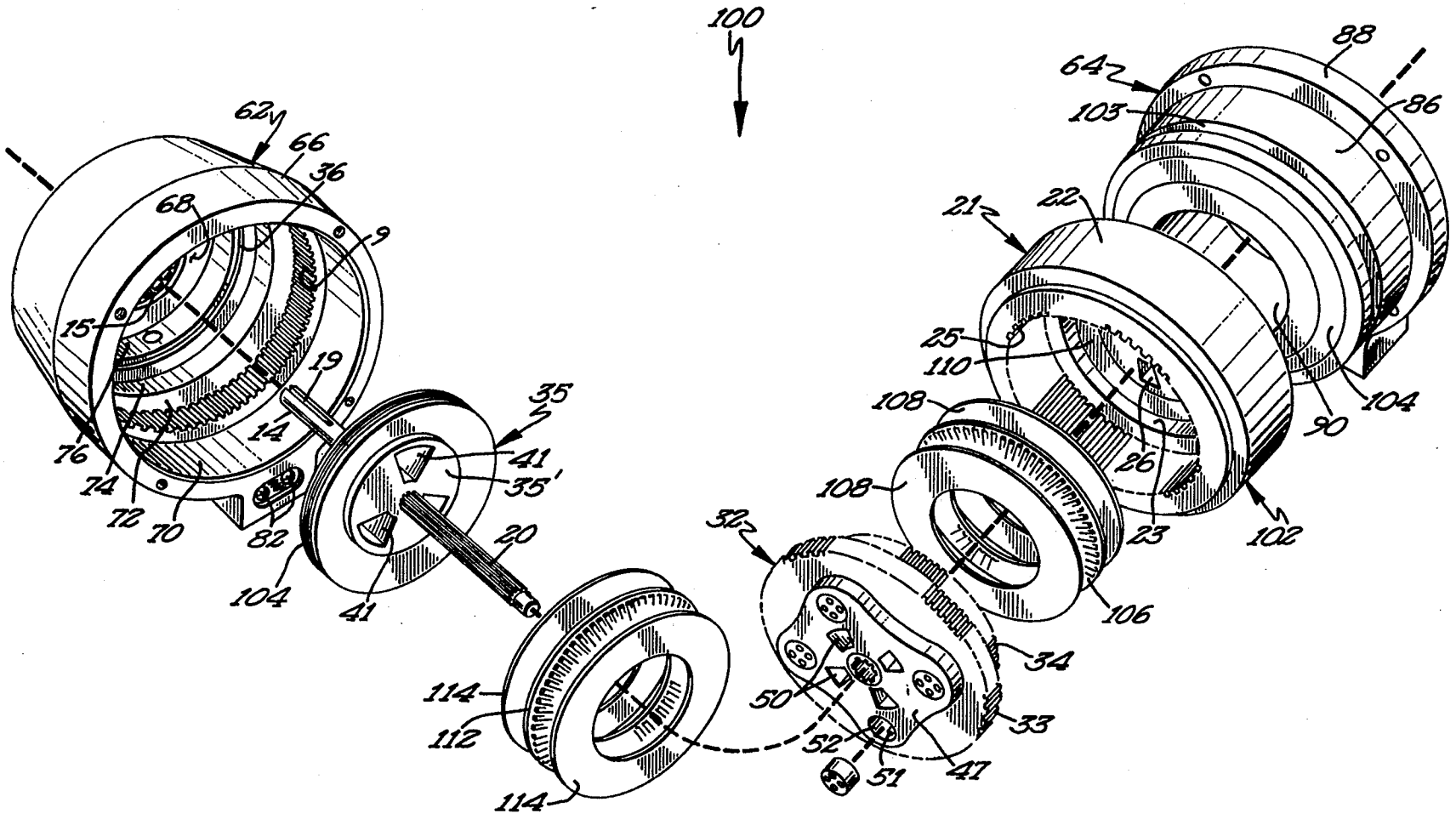
FIG. 2 shows an exploded perspective view of the rotary fluid displacement apparatus of FIG. 1.

The figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the figures of the drawings, the same numerals designate the same or similar parts. Furthermore, when the terms "first", "second", "internal", "radial", "axial", "inward", "outward", and similar terms are used herein, it should be understood that these terms have reference only to the structure shown in the drawings as it would appear to a person viewing the drawings and are utilized only to facilitate describing the invention.

DESCRIPTION

Rotary fluid displacement apparatus according to the preferred teachings of the present invention is shown in the drawings and is generally designated 100. In the most preferred embodiment of the present invention, apparatus 100 is an improvement of the type shown and described in U.S. Pat. No. 3,944,378. For purpose of explanation of the basic teachings of the present invention, the same numerals designate the same or similar parts in the present figures and the figures of U.S. Pat. No. 3,944,378. The description of the common numerals and apparatus 100 may be found herein and in U.S. Pat. No. 3,944,378 which is hereby incorporated herein by reference.

Referring to the drawings in detail, apparatus 100 includes a two piece casing 60 including a generally cylindrical portion 62 and an end cap 64. Portion 62 includes a first, generally axially extending annular member 66 which integrally intersects with a second, generally radially extending annular member 68. Annular member 66 includes a first axially outward cylindrical cavity 70 which terminates in a second axially inner cylindrical cavity 72 of a smaller diameter and which in turn terminates in a third axially inner cylindrical cavity 74 of a smaller diameter and which in turn terminates in a fourth axially inner cylindrical cavity 76 of a smaller diameter and which in turn terminates in member 68. Cavity 72 includes an integrally formed internal stationary gear 9. Member 68 includes an annular bore 78 for receipt of bearing assembly 15. Cavities 70, 72, 74 and 76 and bore 78 are concentric to each other. A radially extending air passage or fluid conduit 80 extends from the exterior of and through annular member 66 and terminates in cavity 76. In the most preferred form, a pair of axially extending, spaced fluid bores 82 extend through annular member 66 and intersect with and terminate in conduit 80. A suitable plug 84 seals conduit 80 at its intersection with the outer, exterior surface of annular member 66.

End cap 64 includes a first, generally axially extending annular member 86 which integrally intersects with a second, generally radially extending member 88. End cap 64 includes a first axially outward cylindrical cavity 90 defined by a cylindrical inner surface and which terminates in a second axially inner cylindrical cavity 92 of a smaller diameter and having a closed end. A bearing assembly 15 is received in cavity 92. The outer, cylindrical surface of annular member 86 is slideably received in cavity 70, with suitable sealing means such as an O-ring provided therebetween. End cap 64 is removably secured to annular member 66 of portion 62 by any suitable means such as screws extending through member 88 and threadably received in the free end of annular member 66. A first axially extending air passage or fluid conduit 94 is provided radially offset from the center of cavities 90 and 92, radially outward of cavity 92 and intersecting with the inner surface of cavity 90. End cap 64 further includes a pair of axially extending spaced fluid bores 96 extending from an axially inner surface and generally in alignment with bores 82 to a point spaced from the axially outer surface of end cap 64. A single, axially extending port 98 extends from the axially outer surface of end cap 64 and intersects with bores 96. Suitable sealing means can be provided at the interconnection of portion 62 and cap 64 to prevent air leakage to the interior of casing 60 or to the atmosphere from bores 82 and 96.

An elongated drive shaft 14 is Journaled in bearing assemblies 15 mounted in portion 62 and end cap 64 of casing 60. One end of shaft 14 is shown as terminating within and being concealed within end cap 64. The opposite end portion of shaft 14 is rotatably supported and passes and projects outwardly through bore 78 of portion 62 and through a conventional dust seal 18, and is provided with a keyway 19. As shown, shaft 14 extends axially of casing 60 and is coaxial with stationary internal gear 9.

Shaft 14 is formed to provide a splined portion 20 axially inwardly of bearing assemblies 15 for mounting of various elements for rotation with shaft 14. A first fluid transfer element in the form of a primary rotor 21 comprises a drive gear assembly 102 including a cylindrical member 22, an annular plate 23 and a tubular hub 24 integrally formed together. Annular plate 23 generally has axially opposite flat faces. Tubular hub 24 is provided with an axial splined opening closely fitting splined portion 20 of shaft 14. Hub 24 has a size corresponding to and for rotatable and slideable receipt in cavity 90 of end cap 64, with cavity 90 including an annular groove for reception of an O-ring 103 preferably made of rubber or other elastomeric material. Thus, a fluid chamber is formed and defined by hub 24 of rotor 21 and cavity 90 of end cap 64. Hub 24 is provided with a plurality of circumferentially spaced, axially extending fluid passageways 26 therethrough, with three shown for the purpose of the present example. A rotary internal gear 25 is disposed axially outwardly of stationary internal gear 9 and is secured to plate 23 and/or cylindrical member 22 by any suitable means such as by press pins concentrically within cylindrical member A secondary rotor 28 is splined to shaft 14 in an axially spaced relationship to plate 23 of primary rotor 21, with tubular spacers 24' being interposed between hub 24 and secondary rotor 28. In the form of the invention illustrated, secondary rotor 28 is cross-sectionally in the form of an equilateral triangle to define rounded external tooth elements. Secondary rotor 28 is coaxial with shaft 14. Secondary rotor 28 has eccentrically mounted thereon a ring member 30 having internal tooth elements that are one more in number than the tooth elements of secondary rotor 28. Ring member 30 is adapted to partake of orbital movement, with its axis moving in an orbit around the common axis of secondary rotor 28 and shaft 14. Ring member 30 has an outer cylindrical surface on which is Journaled annular member 32, which is formed to provide axially spaced externally toothed gears 33 and 34 that have meshing engagement with respective internal gears 9 and 25. Annular member 32 is carried in common orbit with ring member 30, with gears 33 and 34 being of substantially less diameter than their respective internal gears 9 and 25.

A second, annular plate-like fluid transfer element 35 is further provided including an annular plate extending radially from a hub 35' which is splined on shaft 14 for common rotary movement therewith. Hub 35' has a diameter complementary to cavity 76. Cavity 76 is provided with an annular groove 36 for reception of a sealing ring 37 preferably made of rubber or other elastomeric material for sealing engagement with the axially outer end of hub 35'. Thus, a fluid chamber is formed and defined by hub 35' of element 35 and cavity 76 of portion 62. Hub 35' of transfer element 35 is formed to provide a plurality of circumferentially spaced, axially extending fluid passageways 41 with three in number being shown. Fluid passageways 41 in fluid transfer element 35 communicate with cavity 76. Fluid transfer element 35 is axially spaced from secondary rotor 28 by a tubular spacer 24' splined to shaft 14.

Shaft 14 is held against axial movement in casing 60 by abutting the axially outer face of transfer element 35 with the radially extending wall of cavity 74 and by abutting the axially outer face of plate 23 with the axially inner end of end cap 64, with suitable needle bearings 104 sandwiched between first and second thrust washers being positioned between the abutting surfaces to reduce friction. Snap ring 42 holds rotors 21 and 28 and fluid transfer element 35 in their proper positions on shaft 14 through the medium of a threaded collar 44.

Secondary rotor 28 and ring member 30 are provided with axially inner and outer annular valve discs 46 and 47, respectively, these being Journaled on respective ones of tubular spacers 24'. Valve disc 46 is sandwiched between the face of annular plate 23 and the first end faces of secondary rotor 28, ring member 30, and annular member 32. Valve disc 47 is sandwiched between the face of fluid transfer element 35 and the other end faces of secondary rotor 28, ring member 30, and annular member 32. valve discs 46 and 47 cooperate with rotor 28 and ring member 30 to define fluid chambers that successively expand and contract during rotary movement of shaft 14 and rotary and orbital movement of ring member 30. Each of the valve discs 46 and 47 have a plurality of respective fluid passages 49 and 50 therethrough which move into and out of register with different ones of the fluid chambers defined by discs 46 and 47, rotor 28, and ring member 30 as well as into and out of register with different ones of fluid passageways 26 and 41 in primary rotor 21 and fluid transfer element 35. In the present embodiment, fluid passages 49 and 50 in each of their respective valve discs 46 and 47 are four in number.

Means for imparting rotary movement to valve discs 46 and 47 responsive to orbital movement of ring member 30 comprises a plurality of pins or shafts 51 that project axially outwardly from ring member 30 and into washers received in circumferentially spaced openings 52 extending axially through valve discs 46 and 47. Shafts or pins 51 partake of orbital movement in common with ring member 30 within their respective valve disc openings 52, the relative diameters of pins 51 and their respective openings 52 and the location of openings 52 being such that pins 51 and the washers have sliding engagement with the circular walls of openings 52. Thus, valve discs 46 and 47 partake of only rotary movement on the axis of shaft 14, such movement being imparted to them by rotary movement of ring member 30 during orbital movement thereof.

It will be appreciated that apparatus 100 may be operated as a fluid motor or as a fluid pump, with equal facility, and can also be operated as a combination motor-pump or metering device. when operated as a motor, fluid, such as air under pressure, can be introduced to the interior of casing 60 through conduit 94 to cavity 90 from whence it flows through passageways 26 and registering ones of passages 49 into given ones of the fluid chambers defined by rotor 28, ring member 30, and valve discs 46 and 47, causing these fluid chambers to expand by imparting orbital movement to ring member 30. At the same time, air within the contracting ones of the chambers defined by rotor 28, ring member 30, and valve discs 46 and 47 is allowed to discharge through registering ones of passageways 41 and passages 50 and outwardly through cavity 76, conduit 80, air bores 82 and 96, and port 98. During orbital movement of ring member 30 and annular member 32, engagement of external gears 33 and 34 with their respective internal gears 9 and 25 causes rotation to be imparted to primary rotor 21 and shaft 14. As shaft 14 rotates, so also does secondary rotor 28. The relative number and location of passageways 26 and passages 49, as well as the gearing arrangement between annular member 32 and rotor 21 causes one of the passageways 26 to be in register with a fluid passage 49 when the passage 49 is in register with an expanding one of the fluid chambers defined by rotor 28, ring member 30, and valve discs 46 and 47. At the same time, one of the fluid passageways 41 is in register with a fluid passage 50 and in register with one of the contracting chambers defined by rotor 28, ring member 30, and valve discs 46 and 47 to permit discharge of air from the contracting chamber to cavity 76. It should be noted that when air under pressure is introduced to the interior of casing 60 through air bores 82 and 96, port 98 and conduit 80 to cavity 76, apparatus 100 will also operate as a motor but rotation of shaft 14 will be in the opposite direction.

It should then be appreciated that it is undesirable for air pressure to leak from the rotor stack assembly to cavities 70, 72, and 74 of casing 60 and then possibly to the atmosphere, resulting in reduced operation efficiency. This has been a major problem in prior rotary fluid displacement apparatus, with apparatus 100 according to the teachings of the present invention overcoming this problem. Particularly, a major source of leakage from the rotor stack assembly occurs at the abutting sliding and rotating surfaces or faces between valve discs 46 and 47, rotor 21, and element 35. Specifically, due to the sliding and rotating abutment, rotor 21 and element 35 were subject to wear allowing leaking at their abutment with valve discs 46 and 47. It should be noted that openings 52 of discs 46 and 47 have a radial extent within the radial extent of the fluid chambers defined by rotor 28, ring member 30, and valve discs 46 and 47 and provide a leak path therethrough to the interior of casing 60 if the abutting and sliding surfaces or faces between valve discs 46 and 47, rotor 21 and element 35 are worn. Apparatus 100 according to the teachings of the present invention provides a needle bearing 106 sandwiched between first and second thrust washers 108 located intermediate and abutting the faces of valve disc 46 and rotor 21 and piloted in an annular groove 110 formed in annular plate 23. Additionally, apparatus 100 according to the teachings of the present invention provides a needle bearing 112 sandwiched between first and second thrust washers 114 located intermediate and abutting the faces of valve disc 47 and fluid transfer element 35 and piloted on hub 35'. In the most preferred form, in initial manufacture, a small amount of wear is allowed to hubs 24 and 35' before annular plate 23 and fluid transfer element 35 begin to ride upon bearings 106 and 112 to maintain a good seal between the parts. It should then be noted that bearings 106 and 112 provide a rolling support between valve discs 46 and 47, rotor 21, and element 35 to minimize the friction therebetween. Such rolling support (as opposed to the prior sliding interface) is unique to apparatus 100 and is believed to be against conventional thinking in the field of rotary fluid displacement apparatus and in fields utilizing rotating valve plates. Particularly, prior to the present invention it was thought to be undesirable to place anything between the rotating valve plate and the element which includes the cavities which are being valved by the valve plate as anything so placed would provide a leak path. Surprisingly, the use of bearings 106 and 112 and washers 108 and 114 has significantly increased the wear life of rotor 21 and element 35 (which was previously subject to frictional wear) and dramatically increased the ability to prevent air leakage between valve discs 46 and 47, rotor 21, and element 35. In fact, the use of bearings 106 and 112 and washers 108 and 114 according to the teachings of the present invention significantly increased product life and apparatus efficiency, with actual testing showing increased life of over 10 times over prior apparatus and with a product failure occurring as the result of other components than valve discs 46 and 47, rotor 21, and element 35. Thus, the introduction of a potential leak path against conventional thinking has resulted in greater apparatus efficiency and life.

Apparatus 100 according to the teachings of the present invention is also advantageous in the event that leak of air pressure from the rotor stack assembly should occur to cavities 70, 72, and 74 of casing 60. Specifically, prior casings for rotary fluid displacement apparatus were formed from multiple pieces which provided many potential leak paths. In this regard, often prior apparatus included end caps which abutted against the other casing components relying upon gaskets and sealing compounds therebetween which are especially prone to leakage. Also, the individual components were often manufactured from multiple pieces which were secured together utilizing screws, locking pins, and the like which present multiple leak paths between the pieces themselves and around the securing means. Such leak paths allow the release of air pressure (released from the rotor stack assembly) from prior casings. Casing 60 according to the preferred teachings of the present invention overcomes these problems by utilizing only two pieces each being of a single component. In addition, the sealing of the pieces forming casing 60 (portion 62 and end cap 64) and of casing 60 with the rotor stack assembly utilizes O-ring type seals which provide relatively trouble-free and consistent performance even after repair of apparatus 100 including repairs in the field by users of apparatus 100. In fact, apparatus 100 according to the preferred teachings of the present invention allows ease of field service by simply replacing the rotor stack assembly for rebuilding by the factory.

Additionally, casing 60 is also advantageous for manufacturing reasons. Specifically, one major problem of prior casings was that of assembling the casing with the components concentric to the drive shaft and keeping them concentric after use and wear. In this regard, relative movement between the components especially after wear may occur when none in fact is desired with integral component pieces, the components can each be machined from the casting with the same centerline so that concentricity is not a problem. In addition to eliminating many parts, grey iron castings have reduced noise and vibration problems which occurred for prior rotary fluid displacement apparatus because of the added weight and vibration dampening characteristics of grey iron.

Likewise, it should be appreciated that casing 60 is also advantageous for installation reasons. Specifically, fluid conduit 94 and port 98 (which form the input and output for apparatus 100 depending upon the desired rotational direction of shaft 14 and upon the desired operation of apparatus 100) extend generally axially from end cap 64 such that apparatus 100 does not require installation plumbing to extend radially outward of casing 60. Thus, apparatus 100 according to the preferred teachings of the present invention can be utilized in existing locations to replace many electrical motors where fire and/or explosion is of special concern, with casing 60 in the preferred form having a similar physical appearance to electric motors.

Similarly, it should be appreciated that portion 62 of casing 60 is advantageous for several reasons. Specifically, portion 62 can be made from a single casting and the length of annular member 66 cut to the desired length such that cavity 70 accommodates the desired size of rotor stack assembly (the desired size fluid chambers defined by rotor 28, ring member 30, and valve discs 46 and 47) and thus the desired size of apparatus 100. Further, the free end of annular member 66 and/or annular member 68 can be machined to allow stacking and interconnection of apparatus 100 in series for the desired output requirements. It should then be appreciated that each of the components' rotor stack assemblies of each of such stacked apparatus rotate in the same direction and specifically are not diametrically opposite to each other in a manner as the embodiment shown in U.S. Pat. No. 3,944,378 and which have a tendency to work against each other and lock up.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. In a rotary fluid displacement apparatus including at least a first valve disc having a face and a plurality of first fluid passages therethrough, and a fluid transfer element having a face and a plurality of fluid passageways therethrough, with the valve disc being rotatable relative to the fluid transfer element with the fluid passageways being movable into and out of registration with the fluid passages, with the valve disc blocking fluid communication through the fluid passageways when the fluid passageways are out of registration with the fluid passages, the improvement comprising means for providing a rolling support between the faces of the valve disc and the fluid transfer element.

2. The rotary fluid displacement apparatus of claim 1 wherein the rolling support providing means comprises, in combination: a first thrust washer for abutting with the face of the fluid transfer element; a second thrust washer for abutting with the face of the valve disc; and needle bearings sandwiched between the first and second thrust washers.

3. The rotary fluid displacement apparatus of claim 2 wherein the fluid transfer element comprises, in combination: a hub; and an annular plate extending radially from the hub, with the fluid passageways extending axially through the hub.

4. The rotary fluid displacement apparatus of claim 3 further including a casing having a cylindrical cavity, wherein the hub is cylindrical and of a size for slideable and rotatable receipt in the cavity of the casing; and O-ring sealing means between the cavity and the hub to define a fluid chamber in the casing in fluid communication with the fluid passageways.

5. The rotary fluid displacement apparatus of claim 4 wherein the needle bearings and the thrust washers are piloted on the hub.

6. The rotary fluid displacement apparatus of claim 4 wherein the face of the annular plate of the fluid transfer element includes an annular groove of a size for receipt of the needle bearings and the thrust washers.

7. The rotary fluid displacement apparatus of claim 4 further including a rotor having external tooth elements and rotatable with the fluid transfer element; and a cooperating ring member encompassing the rotor eccentric therewith for rotary and orbital movement relative thereto, with the ring member having internal tooth elements one more in number than the tooth elements of the rotor, with the tooth elements of the ring member and the rotor having substantially sealing engagement with each other and cooperating to define inner and outer walls of successively expanding and contracting fluid chambers during said rotary and orbital movement of the ring member, and with the valve disc located intermediate the fluid transfer element and the rotor and the cooperating ring member, with the fluid passages being in fluid communication with the expanding and contracting fluid chambers.

8. The rotary fluid displacement apparatus of claim 7 further including means operatively connecting the valve disc to the ring member for imparting rotary movement to the valve disc responsive to rotary movement of the ring member during said orbital movement thereof.

9. The rotary fluid displacement apparatus of claim 4 wherein the casing further includes a fluid conduit extending from the exterior of the casing to the cavity.

10. The rotary fluid displacement apparatus of claim 9 wherein the fluid conduit extends generally perpendicular to the rotation axis of the valve disc relative to the fluid transfer element; and wherein the casing further comprises at least a first fluid bore extending generally parallel to the rotation axis of the valve disc relative to the fluid transfer element and intersecting with the fluid conduit; and means for plugging the fluid conduit at the exterior of the casing.

11. The rotary fluid displacement apparatus of claim 10 wherein the casing further comprises a second fluid bore spaced from and parallel to the first fluid bore, with the first and second fluid bores terminating within the casing; and a single fluid port extending from the exterior of the casing and intersecting with the first and second fluid bores and extending in a direction parallel to the first and second fluid bores.

12. The rotary fluid displacement apparatus of claim 1 wherein the fluid transfer element comprises, in combination: a hub; and an annular plate extending radially from the hub, with the fluid passageways extending axially through the hub.

13. The rotary fluid displacement apparatus of claim 12 wherein the face of the annular plate of the fluid transfer element includes an annular groove of a size for receipt of the rolling support providing means.

14. The rotary fluid displacement apparatus of claim 1 further comprising, in combination: a casing having a cylindrical cavity, with the fluid transfer element including a cylindrical hub of a size for slideable and rotatable receipt in the cavity of the casing; and O-ring sealing means between the cavity and the hub to define a fluid chamber in the casing in fluid communication with the fluid passageways.

15. The rotary fluid displacement apparatus of claim 14 wherein the fluid transfer element includes an annular groove of a size for receipt of the rolling support providing means.

16. The rotary fluid displacement apparatus of claim 1 further comprising, in combination: a rotor stack assembly including a shaft, the first fluid transfer element and a second fluid transfer element rotatably fixed on the shaft, and an externally toothed gear; and a casing comprising, in combination: a generally cylindrical portion including a first, generally axially extending annular member integral with a second, generally radially extending annular member, with the second, generally radially extending annular member of the generally cylindrical portion including a bore for passage and rotatable support of the shaft, with the first, generally axially extending annular member of the generally cylindrical portion including at least a first axially outward cylindrical cavity which terminates in a second axially inner cylindrical cavity which terminates in a third axially inner cylindrical cavity which terminates in the bore, with the generally cylindrical portion including a first fluid conduit extending from the exterior of the generally cylindrical portion to the third cavity, with the second cavity including an integrally formed internal gear for gearing engagement with the externally toothed gear of the rotor stack assembly, with the third cavity being of a size for rotatable and slideable receipt of the first fluid transfer element and including an O-ring seal for engagement with the first fluid transfer element; an end cap including a first, generally axially extending annular member integral with a second, generally radially extending annular member, with the outer surface of the first, generally axially extending annular member of the end cap being of a size for slideable receipt in the first cavity and including an O-ring seal for engagement with the first cavity, with the inner surface of the first, generally axially extending annular member of the end cap being of a size for rotatable and slideable receipt of the second fluid transfer element and including an O-ring seal for engagement with the second fluid transfer element, with the end cap including a second fluid conduit extending from the exterior of the end cap to the inner surface of the first, generally axially extending annular member of the end cap; and means for removably securing the end cap to the generally cylindrical portion.

17. A casing for a rotary fluid displacement apparatus including a rotor stack assembly including a shaft, first and second fluid transfer elements rotatably fixed on the shaft, and an externally toothed gear, comprising, in combination: a generally cylindrical portion including a first, generally axially extending annular member integral with a second, generally radially extending annular member, with the second, generally radially extending annular member of the generally cylindrical portion including a bore for passage and rotatable support of the shaft, with the first, generally axially extending annular member of the generally cylindrical portion including at least a first axially outward cylindrical cavity which terminates in a second axially inner cylindrical cavity which terminates in a third axially inner cylindrical cavity which terminates in the bore, with the generally cylindrical portion including a first fluid conduit extending from the exterior of the generally cylindrical portion to the third cavity, with the second cavity including an integrally formed internal gear for gearing engagement with the externally toothed gear of the rotor stack assembly, with the third cavity being of a size for rotatable and slideable receipt of the first fluid transfer element and including an O-ring seal for engagement with the first fluid transfer element; an end cap including a first, generally axially extending annular member integral with a second, generally radially extending annular member, with the outer surface of the first, generally axially extending annular member of the end cap being of a size for slideable receipt in the first cavity and including an O-ring seal for engagement with the first cavity, with the inner surface of the first, generally axially extending annular member of the end cap being of a size for rotatable and slideable receipt of the second fluid transfer element and including an O-ring seal for engagement with the second fluid transfer element, with the end cap including a second fluid conduit extending from the exterior of the end cap to the inner surface of the first, generally axially extending annular member of the end cap; and means for removably securing the end cap to the generally cylindrical portion.

18. The casing of claim 17 wherein the first fluid conduit extends generally perpendicular to the shaft of the rotor stack assembly; and wherein the generally cylindrical portion of the casing further comprises, in combination: at least a first fluid bore extending generally parallel to the shaft of the rotor stack assembly and intersecting with the first fluid conduit; and means for plugging the first fluid conduit at the exterior of the generally cylindrical portion.

19. The casing of claim 18 wherein the generally cylindrical portion further comprises, in combination: a second fluid bore spaced from and parallel to the first fluid bore, with the first and second fluid bores terminating in the free end of the first, generally axially extending annular member of the generally cylindrical portion; and wherein the end cap comprises, in combination: first and second fluid bores parallel to the shaft of the rotor stack assembly and in communicative alignment with the first and second bores of the generally cylindrical portion, with the first and second fluid bores extending to a point spaced from the axially outer surface of the end cap; and a single fluid port extending from the axially outer surface of the end cap and intersecting with the first and second fluid bores of the end cap.

20. The casing of claim 19 wherein the single fluid port extends in a direction parallel to the first and second fluid bores of the end cap and the shaft of the rotor stack assembly, with the second fluid conduit being parallel to and spaced from the single fluid port.

* * * * *

UNITED STATES PATENT AND TRADEMARK OFFICE
CERTIFICATE OF CORRECTION

PATENT NO. : 5,405,254

DATED : April 11, 1995

INVENTOR(S) : David R. Hennessy et al.

It is certified that error appears in the above-identified patent and that said Letters Patent is hereby corrected as shown below:

Title page, [63], after "Continuation of" insert --PCT/US 93/01204 filed February 10, 1993, abandoned, which is a continuation of--.

Title page, [30], delete "Foreign Application Priority Data..." to and including "...930721".

Title page, [57], line 17 of ABSTRACT, after "sliding" insert --,--.

Column 4, line 4, cancel "Journaled" and substitute therefor --journaled--.

Column 4, line 37, after "member" insert --22.--.

Column 4, line 52, cancel "Journaled" and substitute therefor --journaled--.

Column 5, line 21, cancel "Journaled" and substitute therefor --journaled--.

Column 5, line 28, cancel "valve" and substitute therefor --Valve--.

Column 8, line 46, cancel "first".

Column 8, line 46, before "fluid transfer" insert --first--.

Column 12, line 12, cancel "the", first occurrence, and substitute therefor --a--.

UNITED STATES PATENT AND TRADEMARK OFFICE

CERTIFICATE OF CORRECTION

PATENT NO. : 5,405,254

DATED : April 11, 1995

INVENTOR(S) : David R. Hennessy, et. al.

It is certified that error appears in the above-indentified patent and that said Letters Patent is hereby corrected as shown below:

Column 1, line 7, cancel "Feb. 2," and substitute -- Feb. 10,--.

Signed and Sealed this

Twelfth Day of September, 1995

*Attest:*

Bruce Lehman

BRUCE LEHMAN

*Attesting Officer*

*Commissioner of Patents and Trademarks*